US005794702A

United States Patent [19]

Nobileau

[11] Patent Number: 5,794,702

[45] Date of Patent: Aug. 18, 1998

[54] METHOD FOR CASING A WELLBORE

[76] Inventor: Philippe C. Nobileau, #4-40 ch du Vinaigrier Villefranche - Corne d'Or, 06300 Nice, France

[21] Appl. No.: 698,662

[22] Filed: Aug. 16, 1996

[51] Int. Cl.[6] ..... E21B 43/00

[52] U.S. Cl. ..... 166/380; 166/207

[58] Field of Search ..... 166/207, 380, 166/384, 77.2

[56] References Cited

U.S. PATENT DOCUMENTS

| | | | |
|---|---|---|---|
| 1,233,888 | 7/1917 | Leonard . | |
| 1,494,128 | 5/1924 | Primrose | 166/207 |
| 3,104,703 | 9/1963 | Rike et al. . | |
| 3,297,092 | 1/1967 | Jennings | 166/207 |
| 3,358,769 | 12/1967 | Berry . | |
| 3,489,220 | 1/1970 | Kinley | 166/207 |
| 3,948,321 | 4/1976 | Owen et al. . | |
| 4,501,327 | 2/1985 | Retz . | |
| 4,681,169 | 7/1987 | Brookbank, III . | |
| 4,723,579 | 2/1988 | Hyodo et al. . | |
| 5,291,956 | 3/1994 | Mueller et al. . | |
| 5,337,823 | 8/1994 | Nobileau . | |
| 5,348,095 | 9/1994 | Worrall et al. . | |
| 5,411,085 | 5/1995 | Moore et al. . | |
| 5,425,559 | 6/1995 | Nobileau . | |
| 5,487,411 | 1/1996 | Goncalves . | |
| 5,494,106 | 2/1996 | Gueguen et al. . | |
| 5,667,011 | 9/1997 | Gill et al. . | |

FOREIGN PATENT DOCUMENTS

| | | | |
|---|---|---|---|
| 0976019 | 11/1982 | U.S.S.R. | 166/207 |

*Primary Examiner*—William P. Neuder
*Attorney, Agent, or Firm*—James E. Bradley

[57] ABSTRACT

Casing is installed in a well in a folded collapsed condition by uncoiling it from a reel. Two strings of tubing extend continuously through the collapsed casing. One of the strings of tubing is connected to a cement shoe at the lower end of the casing. An opening tool is located above the cement shoe and includes a piston. The other string of tubing extends to a pressure chamber that is between the piston and the cement shoe. After the casing is lowered with a running tool to the desired depth, cement is pumped down the first string of tubing, which flows back up the annulus surrounding the casing. A liquid is then pumped down the second string of tubing into the pressure chamber, causing the piston to push the opening head upward relative to the casing and the strings of tubing. The forming head opens the casing from the collapsed condition into a cylindrical configuration. The running tool retrieves the strings of tubing, opening tool and piston at the conclusion of the opening process.

38 Claims, 5 Drawing Sheets

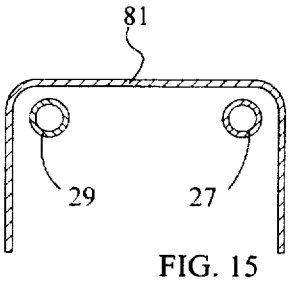
FIG. 15
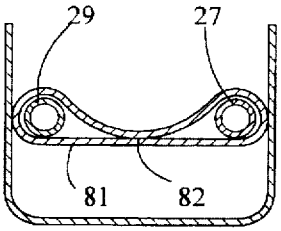
FIG. 16
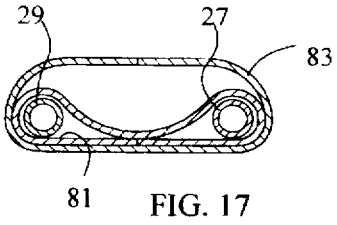
FIG. 17
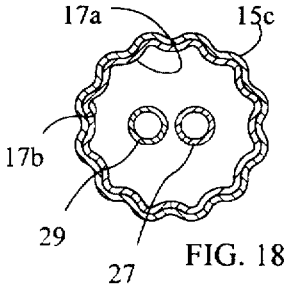
FIG. 18
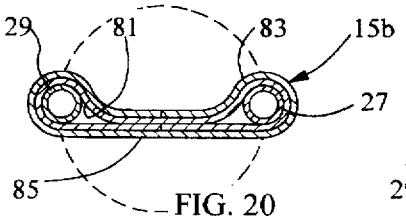
FIG. 20
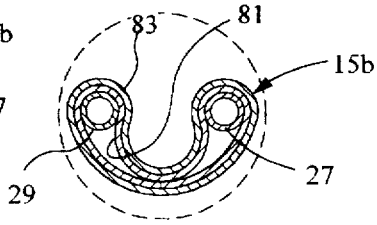
FIG. 21
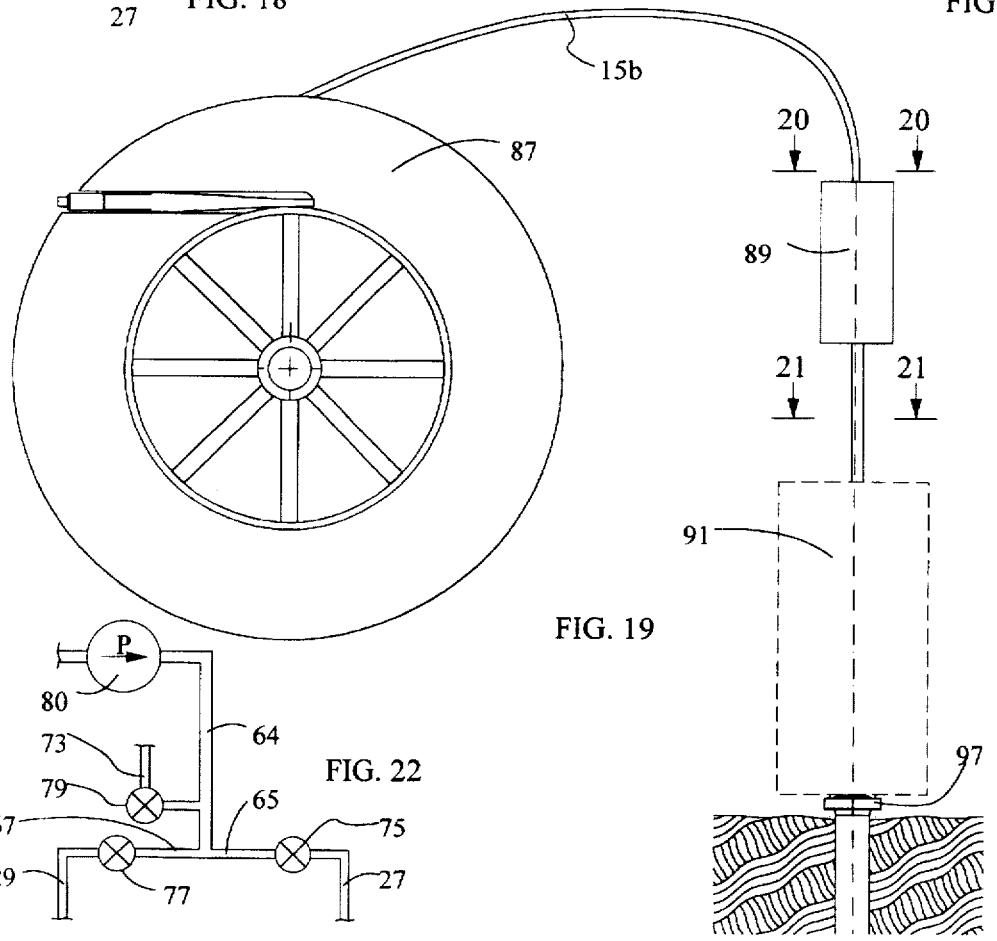
FIG. 19
FIG. 22

METHOD FOR CASING A WELLBORE

TECHNICAL FIELD

This invention relates in general to installing well casing in oil and gas wells and in particular to a method involving fabricating and collapsing casing, running the collapsed casing into the well and opening the casing into a cylindrical configuration.

BACKGROUND ART

Oil and gas wells are typically drilled by installing a conductor pipe to first depth, then drilling the well to a second depth. A string of casing is made up by coupling together sections of pipe, each being about forty feet long, and lowering the string inside the conductor pipe in a nested arrangement. Cement is then pumped down the casing which flows back up the annulus between the casing and the open borehole. Drilling is resumed to a third depth and the process is repeated with another smaller diameter nested casing. An even smaller diameter string of casing may be installed at a fourth depth.

These casings serve to support the borehole wall and to prevent undesired outflow of drilling fluid into the formation or inflow of fluid from the formation into the borehole from strata other than the target production strata. The nested arrangement requires a relative large borehole at the upper part of the wellbore due to the thickness of casing couplings and also due to the minimum clearance necessary between casing to displace cement in the annulus space.

Larger boreholes are more costly to drill since they require larger drill bits, more mud, and more cuttings disposal. Also, a larger diameter pipe has a lower pressure rating for the same wall thickness than a smaller diameter pipe, in consequence each of the casings has to cover the previous one up to the wellhead to enhance the pressure capability as the well goes deeper. Also conventional casing requires a derrick to make-up the pipe sections and lower the casing string into the well. Derricks are big and costly to move, and running casing in forty foot sections is time consuming.

Liners are employed in some wells. A liner is similar to a casing, however, rather than extending completely to the surface wellhead, the upper end of the liner is suspended on the lower end of the previous string. Liners still must be run by making-up pipe sections together and are employed usually to extend in limited lengths from only the smallest diameter full length casing installed.

Coil tubing units permit one to rapidly run a continuous metallic tubing into a well. The tubing is plastically coiled on large reels. A pushing mechanism straightens up the tubing and lowers it into the well as it is uncoiled from the reel. Coil tubing is used to circulate fluids into wells for various purposes. However, it is seldom used to serve as casing due to its small diameter. Coil tubing is smaller in diameter than typical casings, which have usually a minimum diameter of five inches. It would require a large reel to be able to coil several thousand feet of metallic casing of five inches in diameter or larger.

DISCLOSURE OF INVENTION

In this invention, a metal strip plate is formed in a generally tubular configuration, and welded longitudinally with at least one string of continuous tubing inserted during the manufacturing process. The casing is then collapsed with the tubing located therein and wound on a small reel due to its small height by comparison to its nominal diameter. The upper and lower end portions of the casings are formed in a somewhat cylindrical configuration. An opening tool is located in the lower end cylindrical portion. The opening tool has a piston and a conical forming head located above the piston. A pressure chamber is created below the piston in the lower end portion of the casing.

The casing is deployed from the reel and folded in a horseshoe shape prior to entering the well. When the casing has reached the proper depth, a fluid is pumped down the tubing into the pressure chamber to open the casing into a cylindrical shape. The fluid pressure acts against the piston to push the opening tool upward. This causes the head of the opening tool to form the casing from the collapsed/folded configuration into a cylindrical configuration. The forming tool and the tubing are then pulled from the casing.

Preferably, two strings of tubing are installed in the casing while it is being manufactured. One of the strings of tubing serves to pump a cement slurry down through a cement shoe located at the lower end of the casing. The cement flows back up the annulus surrounding the casing to cement the casing in place. Then fluid is pumped down the other string of tubing to open the casing.

Also after the opening tool reaches the upper end of the casing, a forging tool is used to expand the upper end cylindrical portion of the casing into a metal-to-metal sealing engagement with the lower end of the previously cased section of the well. In the preferred embodiment, this involves releasing the running tool from the upper end of the casing after the collapsed portion of the casing has been expanded, then lowering the forging tool located above the running tool into the casing. Fluid is then pumped down to radially forge the upper end of the casing into engagement with the lower end of the previous one.

The opening tool includes a forming head with a conical body with flutes. Balls roll along the flutes in rolling engagement with the casing wall as it is being opened to a cylindrical configuration. The balls force the opening of the casing as they roll along the flutes. The balls roll from the flutes into a lower ball passage, an axial passage, into an upper passage, and back into the flutes in a continuous cycle.

BRIEF DESCRIPTION OF DRAWINGS

FIG. 15 is a schematic sectional view illustrating a step in manufacturing the collapsible casing of FIGS. 1A–1D.

FIG. 16 is another schematic sectional view of the casing of FIG. 1A–1D, showing the addition of an outer layer in the case of a multiple layer casing.

FIG. 17 is another schematic sectional view of the casing of FIG. 16, showing the welding of the additional layer.

FIG. 18 is a sectional view illustrating one of the end portions of the casing of FIGS. 1A–1D with a dual layer configuration.

FIG. 19 is a schematic view illustrating the collapsed casing of FIGS. 1A–1D being uncoiled from a reel, folded in a horseshoe shape and lowered into a well.

FIG. 20 is a flattened sectional view of the casing of FIG. 19, shown along the line 20—20 of FIG. 19.

FIG. 21 is a folded sectional view of the casing of FIG. 19, shown along the line 21—21 of FIG. 19.

FIG. 22 is a schematic view illustrating valves for controlling the flow of fluids to the installation apparatus of FIGS. 1A–1D.

BEST MODE FOR CARRYING OUT THE INVENTION

Figure 4:
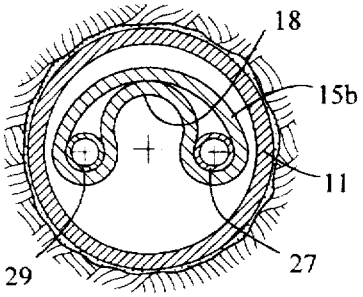
FIG. 4 is a sectional view of an intermediate portion of the casing of the assembly of FIG. 1, taken along the line 4—4 of FIG. 1B.
Figure 5:
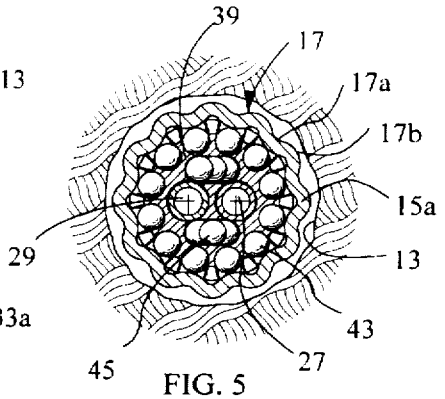
FIG. 5 is a sectional view of a portion of the opening tool of the assembly of FIG. 1C, taken along the line of 5—5 of FIG. 1C.
Figure 6:
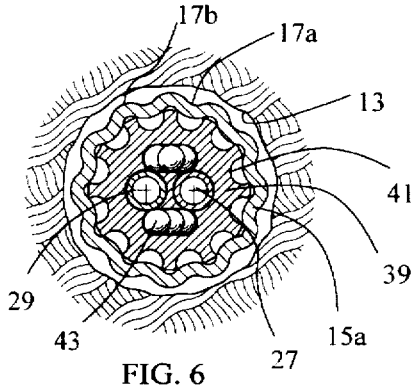
FIG. 6 is another sectional view of a portion of the opening tool of FIG. 1C, taken along the line 6—6 of FIG. 1C.
Figure 7:
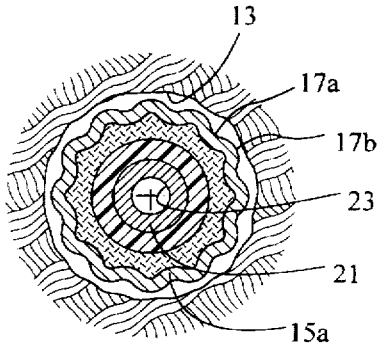
FIG. 7 is a sectional view of the cement shoe of FIG. 1D, taken along the line 7—7 of FIG. 1D.

Referring to FIGS. 1A–1D, the well illustrated has a cased section 11 which has already been cemented in place and an open hole section 13 which extends below cased section 11 to the target depth. A continuous string of casing 15 according to the invention is shown in place in the well with a lower end portion 15*a* at the lower end of the well open hole section 13. Casing 15 has an intermediate portion 15*b* that extends from the lower end portion upward, typically several thousand feet, to an upper end portion 15*c*. Upper end portion 15*c* overlaps the lower portion of cased section 11. Casing lower and upper end portions 15*a*, 15*c* each are somewhat cylindrical with axially extending corrugations 17 as shown in FIG. 5. Corrugations 17 are straight axially extending channels on both the inner and outer diameters of casing, providing inward protruding valleys 17*a* alternating with outward protruding peaks 17*b*. Intermediate portion 15*b*, shown in FIG. 4, is collapsed and folded, having a bight 18 that curves inward and touches the opposite side, which is generally arcuate when lowered into the wellbore.

Figure 1A:
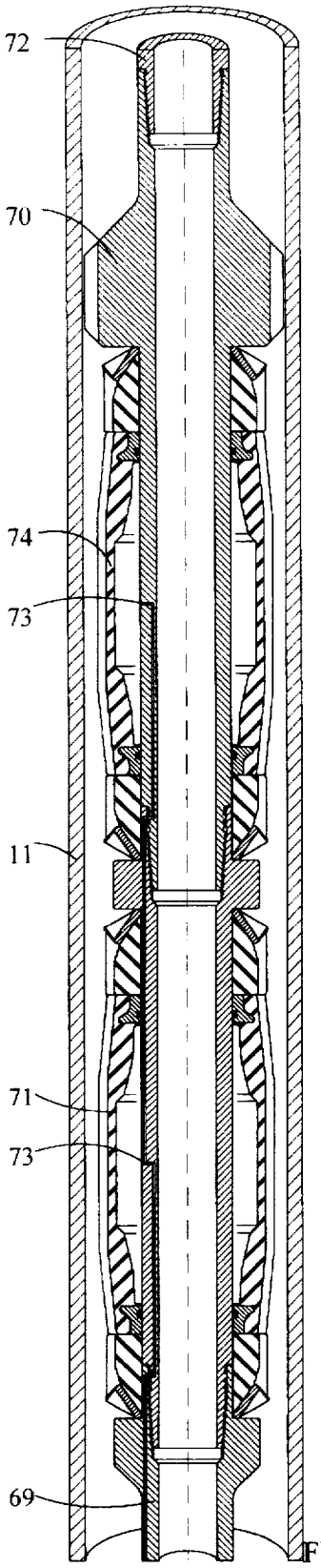
FIGS. 1A–1D comprise a vertical sectional view of an assembly for casing a well, including a collapsed string of casing being installed in a well along with a running tool and an opening tool.
Figure 1B:
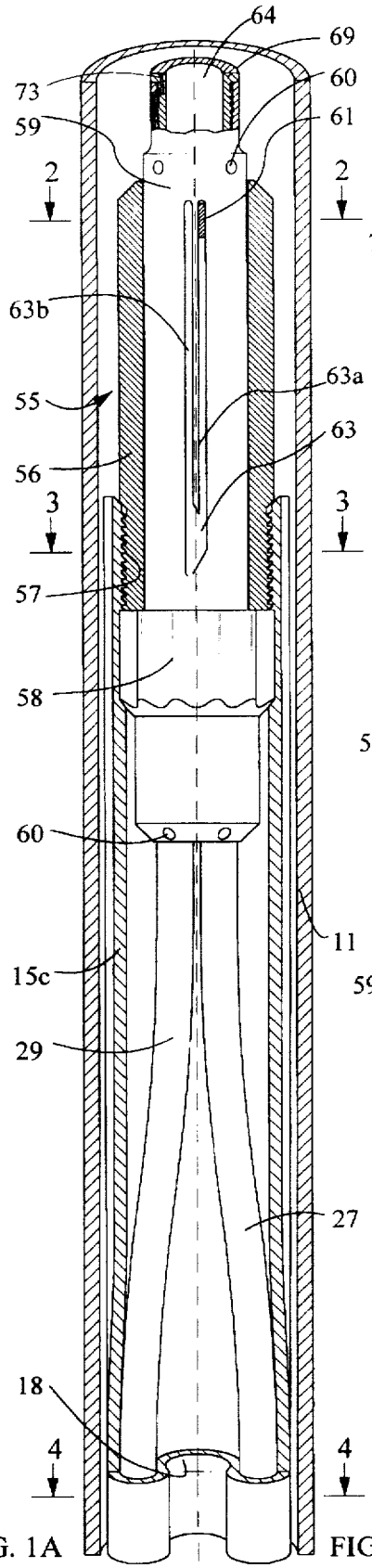
Figure 2:
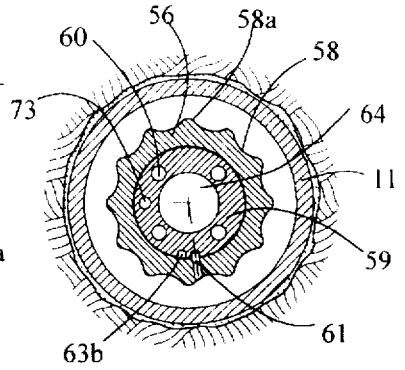
FIG. 2 is a cross sectional view of a portion of the running tool of the assembly of FIGS. 1A–1D, taken along the line 2—2 of FIG. 1B.
Figure 1C:
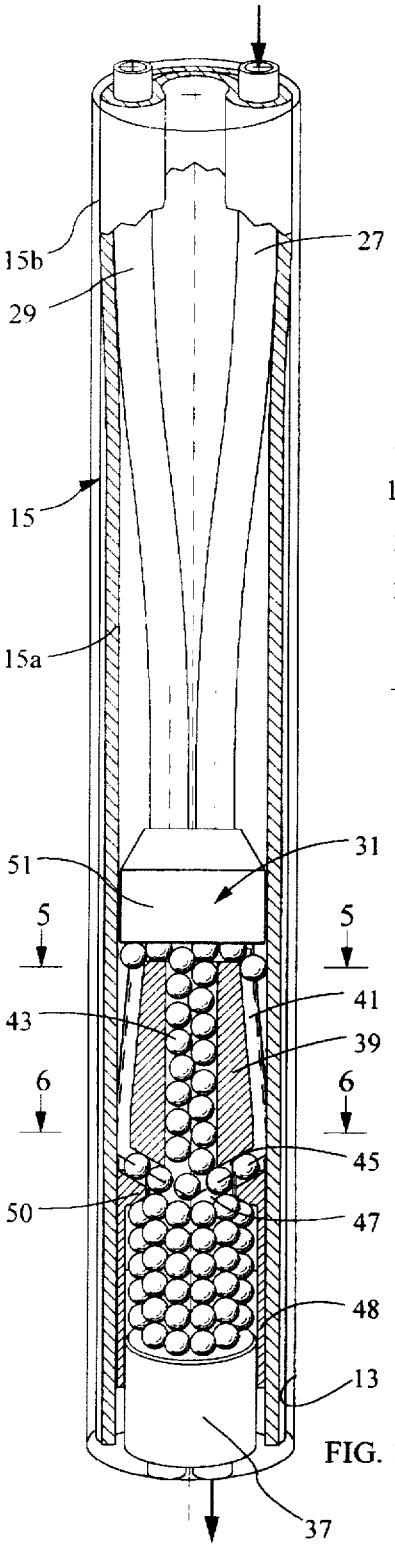
Figure 1D:
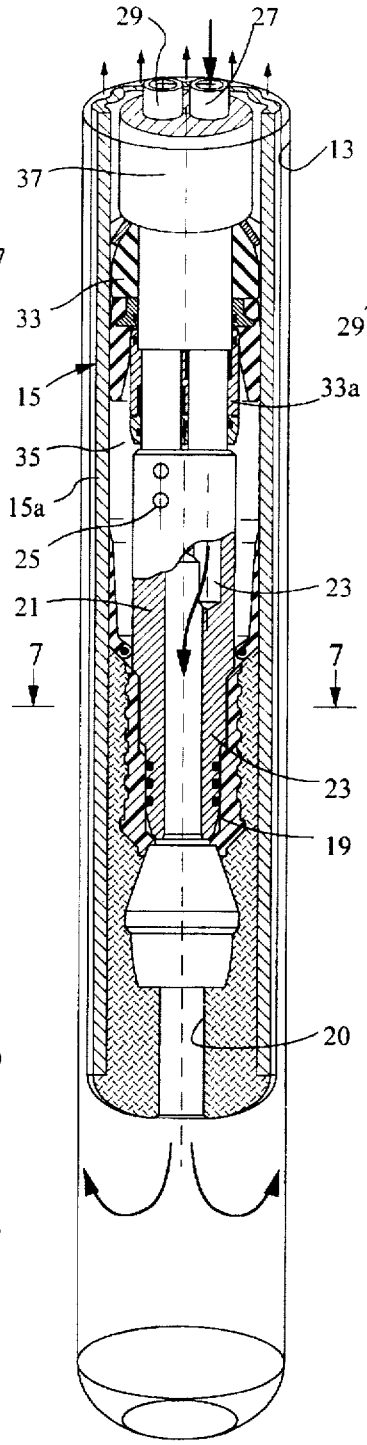

Referring to FIG. 1D, a cement shoe 19 is located at the lower end of casing lower end portion 15*a*. Cement shoe 19 provides an end cap for casing 15 and is made of drillable material with a cementing port 20 extending axially through it. A metal stinger 21 engages sealingly into the upper portion of cementing port 20. Stinger 21 is a tubular member having a conduit 23 for pumping down a cement slurry through cementing port 20 which flow back up the annulus space surrounding the casing 15, as indicated by the arrows. Stinger 21 has also some flow ports 25 which are isolated from conduit 23 and lead to the exterior of stinger 21.

A cement slurry tubing 27 extends continuously through casing 15, and has its lower end coupled to stinger 21 for connecting with conduit 23. Similarly, a fill-up tubing 29 extends continuously through casing 15 and has its lower end coupled to stinger 21 for delivering fluid to ports 25. Tubing strings 27, 29 are conventional metal coiled tubing strings of about one inch in diameter.

An opening tool 31 is housed in casing lower end portion 15*a*, shown in FIG. 1C, above stinger 21. Opening tool 31 includes on its lower end a piston 33. Piston 33 is an elastomeric cup sliding seal which has straight axially extending grooves on its exterior for meshing with the corrugations 17 of casing lower end portion 15*a*. A pressure chamber 35 is located in the space surrounding stinger 21 above cement shoe 19 and below piston 33. In the running-in position, as shown in FIG. 1D, pressure chamber 35 is at its minimum volume. A cylindrical metal piston head 37 extends upward from piston 33. Piston head 37 is movable within a sleeve 48 which has a smaller outer diameter than the inner diameter of casing lower end portion 15*a* at valleys 17*a*.

Figure 8A:
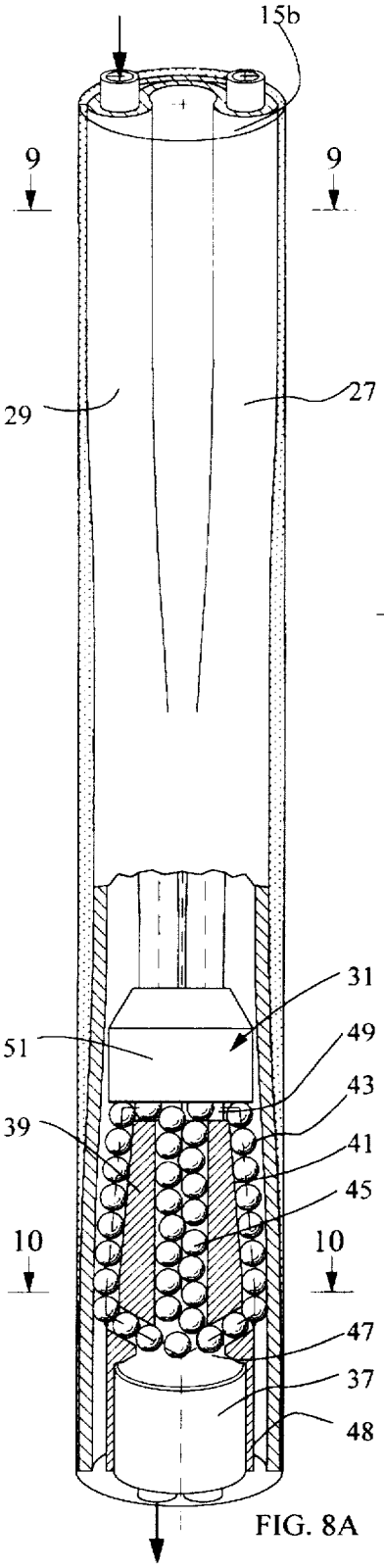
FIGS. 8A and 8B comprise a sectional view of a portion of the assembly of FIG. 1, shown after cementing and during the opening of the intermediate portion of the casing.

Opening tool 31 has a tapered or conical forming head 39 that tapers from a smaller diameter upper end to a larger diameter at lower end. Head 39 has vertical flutes 41 which align with valleys 17*a*, as shown in FIG. 5. A plurality of balls 43 roll down flutes 41 of head 39. Balls 43 are movable through two axial passages 45, a plurality of lower lateral passages 47, and a plurality of upper lateral passages 49. Piston head 37 initially is in a lower position within sleeve 48 of head 39, providing a chamber for a number of balls 43 as shown in FIG. 1C. When piston head 37 is pushed upward, until it will enter in contact with a flange 50 of head 39 as shown in FIG. 8A, it will push the balls 43 upward through axial passages 45. Balls 43 move outward on upper ball passages 49, down flutes 41, and back inward in lower ball passages 47 to axial passages 45 in a continuous cycle as head 39 moves upward in casing 15.

Referring again to FIG. 1C, opening tool 31 has a cylindrical top end 51 which has an outer diameter equal to the minimum inner diameter of casing lower end portion 15*a*, which is measured at valleys 17*a*. Balls 43 will engage valleys 17*a* when contained in flutes 41 and bend the casing wall to line up with expanded peaks 17*b*. While at the upper end of flutes 41, the diameter from one ball 43 to an opposite ball 43 is substantially equal to the diameter between valleys 17*a*. When balls 43 are at the lower ends of flutes 41, as shown in FIG. 8A, the outer diameter of forming tool 31 measured from one ball 43 to an opposite ball 43 at the lower ends of flute 41 is greater than the minimum inner diameter of casing lower end portion 15*c*. Consequently, balls 43 push valleys 17*a* outward to open, in a smooth circular configuration, the upper end of casing lower portion 15*a* as opening tool 31 moves upward.

Due to the relative stiffness of the casing metal wall, the intermediate portion 15*b* is opened from its folded configuration ahead of the opening tool 31, and the contact between the inner wall and the opening tool 31 is made only by the balls 43 rolling on flutes 41 of the conical forming head 39.

Referring to FIG. 1B, a running tool 55 is located at the top of casing upper end portion 15*c*. Running tool 55 is a tubular member which has an outer sleeve 56. The exterior of outer sleeve 56 has vertical grooves 58 between vertical bands 58*a*. Outer sleeve has a set of threads on bands 58*a* which engages a mating set of threads 57 formed on valleys 17*a* in the upper inside end of casing upper end portion 15*c*. Because of corrugations 17 and grooves 58, threads 57 will be discontinuous and located only on the valleys 17*a*.

Outer sleeve 56 is supported by an inner body 59, which has a smooth cylindrical exterior. Outer sleeve 56 has a J-pin 61 that protrudes inwardly into an elongated U-shaped J-slot 63 formed in outer body 59. J-slot 63 has a first leg 63*a* and a parallel second leg 63*a* joined at the bottom. During running-in of casing 15, J-pin 61 will be at the upper end of the first leg 63*a* and maintained in this position by the weight of the casing 15 hanging on the running string connected to the inner body 59. After casing intermediate portion 15*b* has been opened, the weight of the casing 15 is supported by the numerous contacts with the inner wall of the borehole. After opening has been completed, the operator will lower the casing of a running string 72, which lowers the inner body 59 relative to outer sleeve 56. Subsequently, the operator will pick up the running string 72 to place the J-pin 61 in the second leg 63*b*. This causes sleeve 56 to rotate an increment, as shown by the arrow in FIG. 3B, disengaging the threads on outer sleeve 56 from threads 57. Bands 58*a* on outer sleeve 56 align with peaks 17*b*, allowing running tool 55 to be lowered into casing upper end portion 15*c*.

Figure 3A:
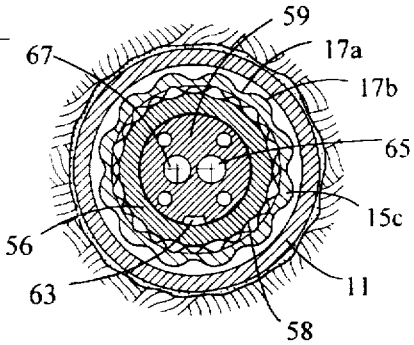
FIG. 3A is a sectional view of another portion of the running tool of the assembly of FIGS. 1A–1D, taken along the line 3—3 of FIG. 1B.

Running tool 55 has a main supply passage 64 connected to the passage in the lower part of a packer string 69 which extends into inner body 59. A cement slurry passage 65 (FIG. 3A) connected to tubing string 27 is located in running tool 55 and can be connected to the lower end of main supply passage 64. Similarly, a fill-up passage 67 connected to tubing string 29 can be connected to the lower end of main supply passage 64.

Figure 12:
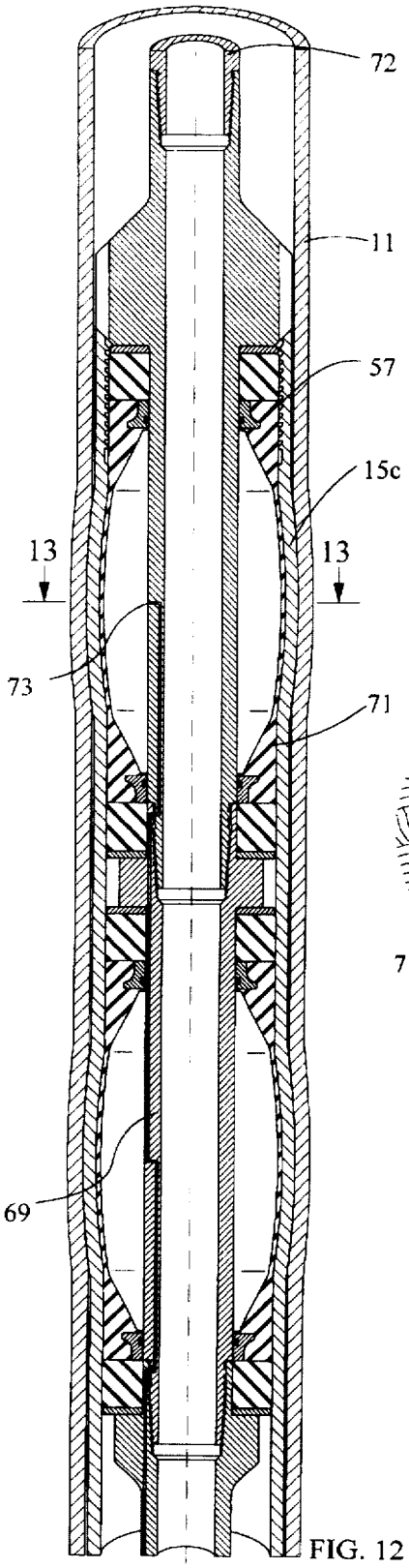
FIG. 12 is a sectional view of the forging packers of the assembly of FIG. 1A, shown lowered into the upper end portion of the casing and in the process of forging the upper end portion of the casing into sealing and locking engagement with the lower end of the upper cased section.
Figure 13:
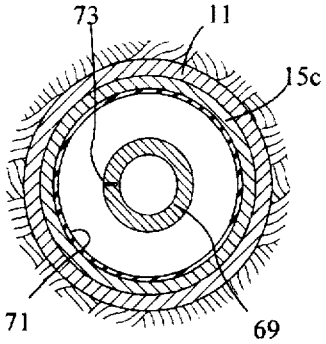
FIG. 13 is a sectional view of one of the forging packers of FIG. 12, taken along the line 13—13 of FIG. 12.

Inner body 59 of running tool 55 is connected to the packer string 69 by threads. The upper part of packer string 69 features a centralizer 70. Two or more forging packers 71 are mounted on the packer string 69 between centralizer 70 and inner body 59. Forging packers 71, when supplied with high internal pressure from a downhole pressure multiplicator (not shown), will inflate and radially expand to plastically forge the upper end of casing upper end portion 15*c*, as shown in FIG. 12. Hydraulic passages 73, extending through packer string 69, can be connected via pressure multiplicator to lower end of main supply passage 64 within running tool inner body 59. Packer string 69 is connected at centralizer 70 to a running string 72 which extends to the surface. Preferably, running string 72 is another string of coiled tubing approximately two inches in diameter. Packers 71 have external axial grooves 74 which will align with valleys 17*a* of casing upper end portion 15*c* when packers 71 are lowered into upper end portion 15*c* with the centralizer 70 landed on top of the casing 15*c* as shown in FIG. 12.

Referring to FIG. 22, in the preferred embodiment, electrically actuated valves 75, 77 and 79 are mounted in running tool inner body 59 (FIG. 1B). Valve 75 is in slurry passage 65 and opens and closes flow to tubing 27. Valve 77 is in opening fluid passage 67 for opening and closing flow from main supply passage 64 to tubing 29. Valve 79 is in pressure passage 73 for opening and closing pressure fluid from main supply passage 64 to forging packers 71 (FIG. 1A). Electrical valve control wires (not shown) extend through coiled running string 72 to the surface to a control panel. A small accumulator (not shown) supplies hydraulic fluid to valves 73, 77, 79 to open and close them when electrically actuated. Pumps 80 on the surface, which could be either cement or mud pumps, are used for delivering pressure fluid down main supply passage 64.

Referring now to FIG. 15, casing 15 is fabricated by drawing a first metal strip 81 from a reel and bending two edges down around two laterally spaced apart, parallel continuous strings of the coil tubing 27, 29. As shown in FIG. 16, the edges are bent over and welded at seam 82. The upper side is bent into a concave shape touching seam 82, while the lower side is flat. Then, a second strip 83 is drawn from a reel and bent to have upturned edges. As shown in FIG. 17, second strip 83 is then bent by rollers around first strip 81 while first strip 81 is in the configuration shown in FIG. 16. Rollers then bend the upper side of strip 83 into a concave shape as shown in FIG. 20. Casing 15 thus is double-walled and has a flat side 85 that extends between parallel tubing strings 27, 29, generally tangent to outer diameter portions of tubing strings 27, 29.

The use of two walls for casing 15 reduces the amount of strain that would otherwise occur during opening plastic deformation with a single wall casing having the same total thickness. Three or more wall casings might be desirable in certain cases. Casing made of multiple walls needs good friction between the walls to resist external pressure. Known friction enhancing techniques such as surface stamping, surface treatment or coating are desirable to offer adequate external pressure capability when open. Also the circumference of the external wall can be made slightly smaller than the previous one to offer adequate fretting of the wall when the casing is open.

Casing 15 will be coiled on a reel 87 (FIG. 19) while in the configuration shown in FIG. 20. Reel 87 is a large member capable of holding 5000 feet or more of casing 15 which has a 5½ inch external diameter when expanded to a cylindrical configuration. FIG. 18 illustrates corrugations 17 which are formed on both the upper and lower end portions 15*c*, 15*a* (FIGS. 1B, 1D) by a roller corrugating operation. The upper and lower end portions 15*c*, 15*a* remain generally cylindrical, although corrugated. The straight upper and lower end portions 15*c*, 15*a* are only a few feet in length and are not wound on reel 87 during transportation from the manufacturing plant to the well site.

When deploying casing 15 from reel 87, casing intermediate portion 15*b* will first pass through a set of bending rollers 89 as shown schematically in FIG. 19. Folding rollers 89 will form casing 15 from the collapsed flattened configuration of FIG. 20 to the folded collapsed configuration shown in FIG. 21. This creates bight 18, and positions tubing strings 27, 29 closer toward each other. The maximum width of casing intermediate portion 15*b* in the horseshoe collapsed configuration of FIG. 21, is less than the inner diameter of cased section 11 (FIG. 1A). The maximum width of casing intermediate portion 15*b* while in the collapsed flattened configuration of FIG. 20 is greater than the inner diameter of cased section 11. Associated with the folding rollers 89, a gripping and pushing mechanism 91 is employed. The folding mechanism 91 is constructed generally as in conventional coil tubing pushing mechanisms. It grips casing 15 without deformation, pulls it from reel 87, and pushes it downward into the well. The horseshoe shape of FIG. 21, resists the compression applied by gripping and pushing mechanism 91 while being pushed into the well.

During installation, casing 15 will be uncoiled from reel 87 and pushed by mechanism 91 into the well until cement shoe 19 is close to the bottom of open hole section 13. The length of casing 15 will be previously selected so that the upper end of portion 15*c* extends into cased section 11 (FIG. 1B), overlapping it over a substantial length. Valves 77, 79 are closed, valve 75 (FIG. 22) is opened, and cement pump 80 pumps a cement slurry 92 (FIG. 9) down the passages 64, 65 through open valve 75 and down cement slurry tubing 27. As shown by the arrows in FIG. 1D, the cement slurry flows down passages 23, 20 and flows up the annulus space surrounding casing 15.

Figure 9:
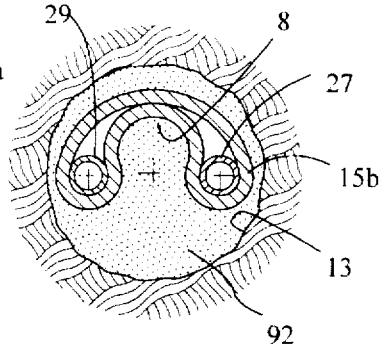
FIG. 9 is a sectional view of the assembly of FIG. 8A, taken along the line 9—9 of FIG. 8A.

A selected volume of cement will be pumped based on an estimate of the total volume of the annulus as if casing 15 had already been opened to the cylindrical configuration. Because of the collapsed rounded or horseshoe configuration of casing intermediate portion 15*b*, a much greater annulus volume initially will be present around casing intermediate portion 15*b*, as shown in FIG. 9, facilitating circulation. Consequently, initially, cement 92 will normally not completely fill the annulus to the top of casing upper portion 15*c*. During the pumping of cement, displaced drilling fluid, or returns, will flow up the corrugations 17 of the casing upper end section 15*c* into the annulus surrounding running tool 55 flow by ports 60. The returns flow up around the forging packers 71 and around the annulus surrounding running string 72 to the surface.

After pumping the calculated volume of cement slurry, a selected volume of flushing fluid will be pumped down cement slurry tubing 27. The volume is selected to be just the amount needed to push cement slurry from conduit 72, tubing 27 and stinger 21 into the open borehole, but substantially no more. The valve 75 is then closed and valve 77 is open. Drilling fluid is pumped down conduit 72, which flows through passages 64, 67 and down fill-up tubing 29. The fluid flows out ports 25 into pressure chamber 35, shown in FIG. 1D.

Figure 8B:
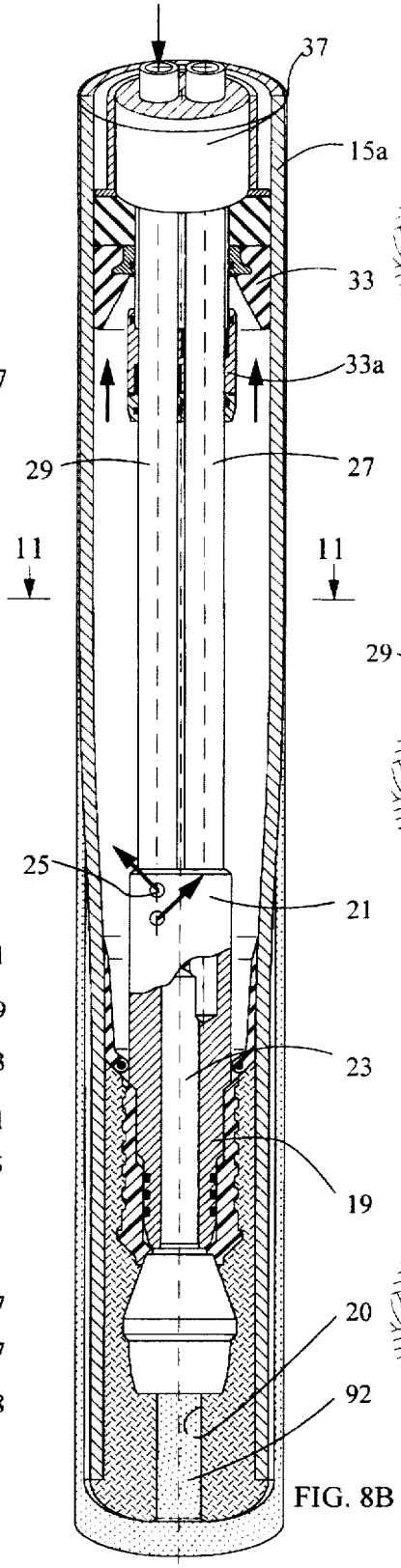

As shown in FIG. 8B, the fluid pushes upward on piston 33, which slides upward relative to tubing strings 27, 29. Piston head 37 pushes balls 43 from the space in sleeve 48 upward into passages 45, as can be seen by comparing FIG. 1D with FIG. 8A. Once in contact with flange 50, the force exerted by piston head 37 begins to push the opening tool 31 upward while tubing strings 27, 29 remain stationary. Due to the engagement of balls 43 with head 39 and casing lower end portion 15*a*, balls 43 are forced to roll down the inclined flutes 41, pushing the valleys 17*a* outward to first remove corrugations 17 of the casing lower end 15*a* and open the intermediate portion 15*b*.

Figure 10:
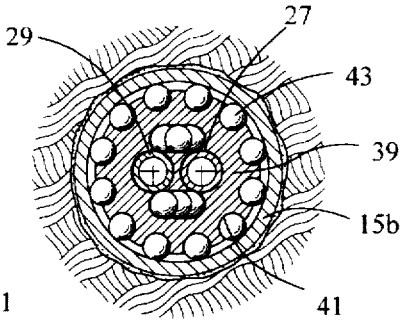
FIG. 10 is a sectional view of the assembly of FIG. 8A, taken along the line 10—10 of FIG. 8A.
Figure 11:
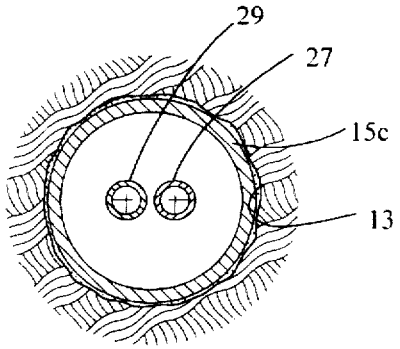
FIG. 11 is a sectional view of the assembly of FIG. 8B, taken along the line 11—11 of FIG. 8B.

After a short distance, all of the balls 43 will be in engagement with conical head 39, as shown in FIG. 8A. Upper end 51 will move upward into the intermediate portion 15*b*. Balls 43 will open casing from the collapsed folded configuration of FIG. 9 to the cylindrical configuration of FIG. 10. During the casing expansion process, the annulus surrounding casing intermediate portion 15*b* decreases, pushing cement slurry 92 upward, and returns will flow up into the channel spaces between corrugations 17 of casing upper end portion 15*c* and cased section 11. Some of the cement slurry 92 will flow out above running tool 55 to insure a proper seal between casings when they will be later forged together. As forming tool 31 moves upward, the volume of pressure chamber 35 increases. This process will continue for the entire length of the casing which could exceed several thousand feet.

Eventually, forming tool 31 will reach casing upper end portion 15*c*. At this point, balls 43 will push outward on valleys 17*a* to round the corrugated configuration 17 into a cylindrical configuration in the same manner as at casing lower end portion 15*a*. Forming tool 31 will eventually contact the lower end of running tool 55, which protrudes a short distance into casing upper end portion 15*c*, shown in FIG. 1B.

Figure 3B:
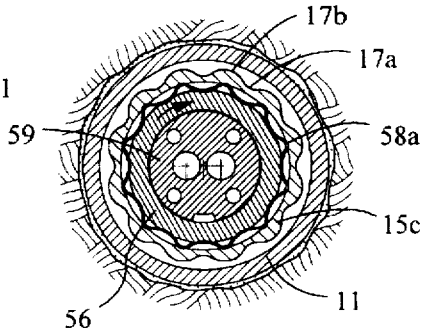
FIG. 3B is another sectional view of the running tool taken along the line 3—3 of FIG. 1B, but showing the running tool shifted to a released position.

The running tool 55 will be released from threads 57 by letting running string 72 go down a short distance, then pulling upward. While lowering, tubing strings 27, 29 will spiral slightly along their lengths to accommodate the compression. The downward movement of inner body 59 relative to outer sleeve 56 causes J-pin 61 to move from first leg 63*a* to second leg 63*b*. When this occurs, an incremental amount of rotation of sleeve 56 occurs relative to inner body 59. This rotation, as illustrated in FIG. 3B, causes threads 57 to disengage from the threads on sleeve 56, releasing running tool 55 from casing upper end portion 15*c*. Grooves 58 on outer sleeve 56 will now be aligned with valleys 17*a*.

The operator then again lowers running string 72 to place forging packers 71 within casing upper end portion 15*c* as shown in FIG. 12. Because of the alignment of axial external grooves 58 and external grooves 74 (FIGS. 1A, 1B) with corrugations 17, outer sleeve 56 and packers 71 will pass downward within casing upper end portion 15*c*. Centralizer 70 is closely spaced to the inner diameter of cased section 11, and will land on the upper edge of casing upper end portion 15*c*. Valve 77 is now closed and valve 79 open (FIG. 22). Pressurized fluid is supplied with mud pump 80 through running string 72. This pressure, which will be multiplied by a known pressure multiplier, causes the forging packers 71 to inflate and plastically deform a portion of upper end portion 15*c* out into a tight gripping and sealing engagement with cased section 11.

Figure 14:
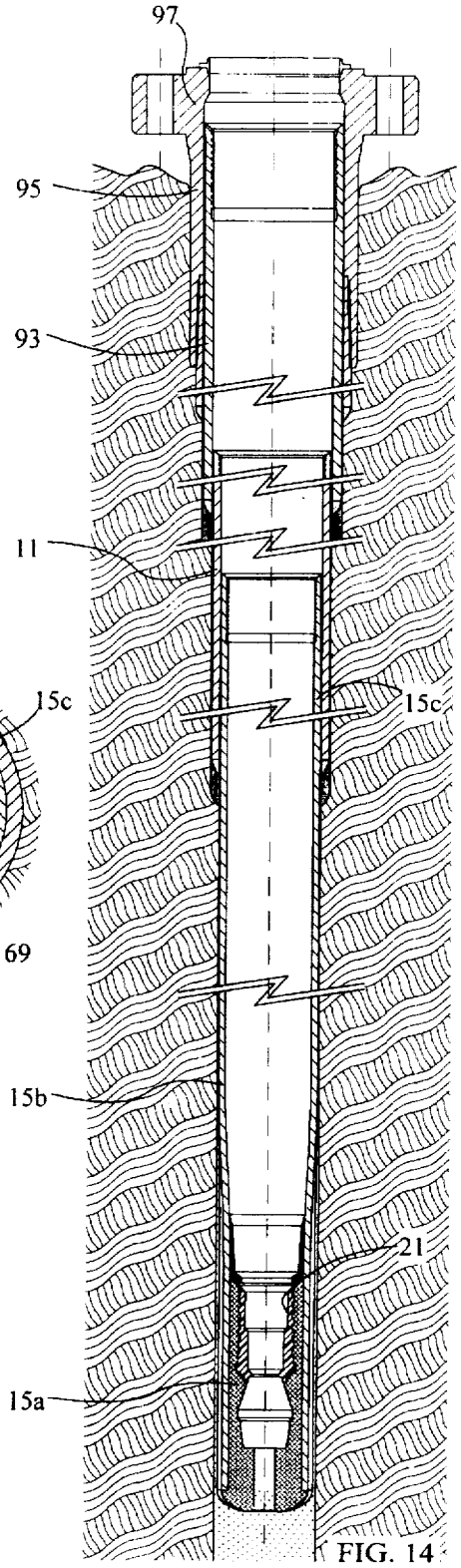
FIG. 14 is a sectional view of the well of FIGS. 1A–1D, shown after the casing has been set and the installation apparatus retrieved.

The fluid pressure is then bled off to allow forging packers 71 to retract. The running string 72 is lifted to pull up running tool 55. Tubing strings 27, 29 will move upward along with stinger 21 and forming tool 31. The entire assembly is pulled out of the well and reeled back on the reel 87. FIG. 14 illustrates casing 15 without the installation apparatus. Casing hydrostatic pressure tests can then be done against the shoe and drilling can resume just after. Also, FIG. 14 shows that cased section 11 may be of a continuous expandable type installed as a liner to another cased section 93. Cased section 93 is shown to again be an expandable type installed in the same manner as described and located within a conductor 95 that is threaded to a wellhead 97.

The invention has significant advantages. As can be seen in FIG. 14, the difference in the inner diameters of one cased section to the next upward cased section is no greater than the wall thickness of the lower cased section. This reduces substantially the loss in diameter from one casing string to another, allowing substantially monodiameter drilling. It allows a smaller cased section at the top of the well for a given bottom diameter and depth than prior art wells. Monodiameter drilling allows smaller bits, less mud, less cuttings to be disposed of, and less cement to achieve the same final size well. This method allows one to have shorter and more different diameter strings than in the prior art. The method can be performed without the need for a hoisting mast if drilling is done by turbine driven drill bit on coiled tubing.

While the invention has been shown in only one of its forms, it should be apparent to those skilled in the art that it is not so limited, but is susceptible to various changes without departing from the scope of the invention. For example, rather than coiled tubing running string 72, if a hoisting mast is available, conventional drill pipe may be used. In that event, rather than electrically actuated valves, the valving can be accomplished by balls or darts dropped down the conduit 64 to selectively close and open the passages. Also, rather than elastomeric packers for expanding the casing upper end portion, other pressure actuated metal radially expandable members may be employed. In addition, in lieu of balls on inclined flutes which circulate in a cycle, expander segments which slide downward from an upper retracted position to a lower expanded position, then stop, could be employed.

I claim:

1. A method for encasing a wellbore, comprising:

forming a metal tubular casing which contains at least one string of tubing therein;

forming an intermediate portion of the casing into a generally collapsed configuration and winding the intermediate portion of the casing onto a reel in the generally collapsed configuration;

placing in a lower end portion of the casing an opening tool which has a piston, a forming head, and a pressure chamber below the piston;

deploying the intermediate portion of the casing from the reel and lowering the casing into the well; and pumping a fluid down the tubing into the pressure chamber, which acts against the piston to push the opening tool upward relative to the casing, causing the forming head to radially open the intermediate portion of the casing from the collapsed configuration into a cylindrical configuration.

2. The method according to claim 1, further comprising retrieving the opening tool and the tubing from the casing after the intermediate portion of the casing has been opened into the cylindrical configuration.

3. The method according to claim 1, further comprising:

prior to lowering the casing into the well, attaching a running tool to an upper end portion of the casing and to the string of tubing; then after the opening tool substantially reaches the upper end portion of the casing as a result of pumping fluid to the pressure chamber, releasing the running tool from the upper end portion of the casing; and retrieving the running tool and along with it the string of tubing and the opening tool.

4. The method according to claim 1, further comprising:

pumping a cement slurry down the casing and back up an annulus surrounding the casing before pumping the fluid down the tubing.

5. The method according to claim 1, wherein the step of forming a casing comprises placing another string of tubing in the casing, and wherein the method further comprises:

pumping a cement slurry down said another string of tubing, which flows back up an annulus surrounding the casing.

6. The method according to claim 1, wherein the step of forming a casing comprises placing another string of tubing in the casing, and wherein the method further comprises:

before pumping the fluid down said first mentioned string of tubing, pumping a cement slurry down said another string of tubing, which flows back up the annulus surrounding the casing.

7. The method according to claim 1, wherein the forming head has a movable engagement member which is movable relative to the piston; and while pumping the fluid to the pressure chamber, causing the movable engagement member to engage the intermediate portion of the casing to bend the intermediate portion of the casing into the cylindrical configuration.

8. The method according to claim 1, wherein:

the step of forming the intermediate portion of the casing into a generally collapsed configuration and the step of deploying the intermediate portion of the casing from the reel into the well includes bending the collapsed configuration of the casing generally into a horseshoe configuration as the intermediate portion of the casing is deployed from the reel and prior to entry into the well.

9. The method according to claim 1, wherein the well has an upper cased section, and the method further comprises:

prior to lowering the casing into the well, attaching a running tool which has a radially expandable member to an upper end of the casing and to the string of tubing;

then while lowering the casing into the well, positioning the running tool in the upper cased section of the well; then expanding the expandable member to plastically deform the upper end of the casing into engagement with the upper cased section; and retrieving the running tool and along with it the string of tubing and the opening tool.

10. A method for encasing an open hole section of a well which has a cased section extending to a first depth, and the open hole section extending to a second depth, comprising:

forming a metal tubular casing into a generally cylindrical upper end portion, a generally collapsed intermediate portion, and a generally cylindrical lower end portion, and inserting laterally spaced apart first and second strings of tubing into the casing during its forming;

winding the intermediate portion of the casing onto a reel;

mounting a cement shoe to the lower end portion of the casing, with the cement shoe being in fluid communication with the first string of tubing;

placing in the lower end portion above the cement shoe an opening tool which has a piston and a conical forming head;

providing a pressure chamber in the lower end portion below the piston and above the cement shoe, and placing the pressure chamber in communication with the second string of tubing;

attaching a running tool to the upper end portion;

deploying the intermediate portion of the casing from the reel and lowering the casing into the well until the cement shoe substantially reaches the second depth and the running tool is located in the cased section;

pumping a cement slurry down the first string of tubing, and flowing the cement slurry back up the annulus between the open hole section and the casing;

pumping a fluid down the second string of tubing into the pressure chamber, causing the piston to push the forming head upward relative to the casing and the strings of tubing, radially opening the intermediate portion of the casing into a cylindrical configuration; then releasing the running tool from the upper end portion of the casing and retrieving the opening tool and the strings of tubing with the running tool.

11. The method according to claim 10, further comprising:

plastically deforming the upper end portion of the casing into engagement with the cased section of the well.

12. The method according to claim 10, further comprising:

mounting a radially expandable member to the running tool above the upper end portion of the casing before lowering the running tool into the cased section of the well;

after the running tool has released from the upper end portion of the casing, lowering the radially expandable member into the upper end portion of the casing; then expanding the radially expandable member, causing it to plastically deform the upper end portion of the casing into engagement with the cased section of the well.

13. The method according to claim 12, further comprising:

expanding the expandable member by pumping a liquid to the expandable member, causing it to plastically deform the upper end portion of the casing into engagement with the cased section of the well.

14. The method according to claim 10, further comprising:

mounting a rolling engagement member to the opening tool on the conical forming head; and while pumping fluid to the pressure chamber, causing the rolling engagement member to engage the intermediate portion of the casing in rolling contact to bend the intermediate portion of the casing wall into cylindrical configuration.

15. The method according to claim 10, wherein:

the step of forming the intermediate portion of the casing comprises flattening the intermediate portion of the casing between the first and second strings of tubing; and the step of deploying the intermediate portion of the casing from the reel includes bending the flattened intermediate portion of the casing into an arcuate surface as the casing is deployed from the reel and prior to entry into the well.

16. An apparatus for encasing a well, comprising:

a string of tubing;

a string of metal casing having an intermediate portion formed in a generally collapsed configuration with the string of tubing contained therein and wound onto a reel;

an opening tool located in a lower end portion of the casing which has a piston, a forming head above the piston, and a pressure chamber in the lower end portion of the casing below the piston;

the intermediate portion of the casing adapted to be deployed from the reel and lowered into the well; and the string of tubing adapted to be connected to a pump for pumping a fluid down the string of tubing into the pressure chamber, which acts against the piston to push the opening tool upward relative to the casing and the string of tubing, causing the head of the opening tool to radially open the intermediate portion of the casing from the collapsed configuration into a cylindrical configuration.

17. The apparatus according to claim 16, further comprising:

an upper end portion of the casing that is generally cylindrical;

a running tool which is secured to an upper end of the string of tubing and to the upper end portion of the casing for lowering the casing containing the string of tubing into the well;

the running tool being releasable from the upper end portion of the casing after the forming tool has substantially reached the upper end portion of the casing for retrieving the opening tool and the string of tubing from the casing after the intermediate portion of the casing has been opened into the cylindrical configuration.

18. The apparatus according to claim 16, further comprising:

another string of tubing located in the casing which is adapted to be connected to a source of a cement slurry for pumping the cement slurry down said another string of tubing, which flows back up an annulus surrounding the casing.

19. The apparatus according to claim 16, further comprising means on the opening tool for engaging the intermediate portion of the casing in rolling contact as the opening tool bends the intermediate portion of the casing into the generally cylindrical configuration.

20. The apparatus according to claim 16, wherein the forming head has a tapered exterior and the apparatus further comprises:

a plurality of flutes on the tapered exterior extending in straight lines from an upper portion of the forming head to a lower portion of the forming head;

a plurality of balls in rolling engagement with the flutes which engage the internal surface of the intermediate portion of the casing in rolling contact while the forming head is pushed upward by the piston.

21. The apparatus according to claim 20, further comprising:

an axial ball passage extending through the forming head;

a lower ball chamber joining a lower end of the axial ball passage, wherein the piston forms a lower side of the lower ball chamber;

an upper lateral passage leading from an upper end of the axial ball passage to upper ends of the flutes;

wherein a plurality of the balls are initially located in the lower ball chamber; and wherein pumping fluid to the pressure chamber initially causes the piston to move upward relative to the forming head, forcing the balls from lower ball chamber through the axial ball passage, out the upper lateral passage and into the flutes, with subsequent upward movement of the forming head by the piston causing the balls in the flutes to engage the casing in rolling engagement, and causing the balls to continuously cycle during the upward movement of the forming head from the lower ball chamber through the axial ball passage, out the upper lateral passage, down the flutes and back into the lower ball chamber.

22. The apparatus according to claim 16, wherein while the intermediate portion of the casing is on the reel, the intermediate portion of the casing has a generally flattened configuration and wherein the apparatus also comprises:

a bending tool for bending the flattened configuration of the intermediate portion of the casing into an arcuate generally horseshoe configuration as the intermediate portion of the casing is deployed from the reel and prior to entry into the well.

23. The apparatus according to claim 16 wherein the well has an upper cased section, and wherein the apparatus further comprises:

a radially expandible member at an upper end of the casing for plastically deforming the upper end of the casing into engagement with the upper cased section of the well.

24. The apparatus according to claim 16 wherein the casing comprises at least two concentric sleeves in tight contact with each other.

25. An apparatus for encasing a well which has an upper cased section and a lower open hole section, comprising:

first and second strings of tubing;

a string of metal casing having an intermediate portion formed in a generally flattened configuration with the first and second strings of tubing contained therein and laterally spaced apart, the intermediate portion of the casing being wound onto a reel;

the casing having a generally cylindrical upper end portion and a generally cylindrical lower end portion;

an opening tool located in the lower end portion which has a piston and a conical forming head;

a cement shoe at the lower end portion below the piston which is in communication with the first string of tubing;

a pressure chamber in the lower end portion of the casing below the piston and above the cement shoe, and which is in communication with the second string of tubing;

a running tool attached to the upper end portion of the casing, the first and second strings of tubing having upper ends which terminate at the running tool;

the running tool being secured to a running string for lowering the running tool and the upper end portion of the casing into the cased section of the well and the intermediate portion and the lower end portion of the casing into the open hole section of the well; wherein the first string of tubing is adapted to be connected to a source of cement for pumping cement down the first string of tubing and out the cement shoe to return up the annulus surrounding the casing; and the second string of tubing is adapted to be connected to a source of a fluid for pumping down the second string of tubing into the pressure chamber, which acts against the piston to push the opening tool upward relative to the casing and the string of tubing, causing the forming head of the tool to open the the intermediate portion of the casing into a cylindrical configuration; and the running tool is releasable from the upper end portion of the casing for retrieving the running tool and the first and second strings of tubing after the intermediate portion of the casing has been opened into the cylindrical configuration.

26. The apparatus according to claim 25, further comprising:

a radially expandible member mounted to the running tool for plastically deforming the upper end portion of the casing into engagement with the cased section of the well.

27. The apparatus according to claim 25, further comprising:

a radially expandable member mounted to the running tool above the upper end portion of the casing;

wherein the running tool and the radially expandable member are lowered into the upper end portion of the casing after the running tool is released from the upper end portion of the casing; and wherein hydraulic pressure is supplied to the expandable member for expanding the radially expandable member, causing it to plastically deform and expand the upper end of the casing into engagement with the cased section of the well.

28. The apparatus according to claim 25, wherein the first and second strings of tubing have upper ends which terminate at the running tool, and wherein the apparatus further comprises:

a valve assembly in the running tool connected to the first and second strings of tubing for closing the upper end of the second string of tubing and opening the upper end of the first string of tubing for allowing cement to be pumped through the first string of tubing, and for opening the upper end of the second string of tubing and closing the upper end of the first string of tubing for allowing fluid to be pumped through the second string of tubing.

29. The apparatus according to claim 25, wherein the forming head has a tapered exterior containing a plurality of flutes extending in straight lines from an upper end portion of the forming head to a lower end of portion of the forming head, and wherein the apparatus further comprises;

a plurality of balls which roll downward on the flutes to engage the internal surface of the casing in rolling contact while the forming head is pushed upward by the piston.

30. The apparatus according to claim 25 wherein the intermediate portion of the casing comprises:

a metal inner sleeve, having an outer wall surface; and a metal outer sleeve surrounding the inner sleeve, the outer sleeve having an inner wall surface in flush contact with the outer wall surface of the inner sleeve.

31. A well casing, comprising:

a metal inner sleeve, having an outer wall surface;

at least one metal outer sleeve surrounding the inner sleeve, the outer sleeve having an inner wall surface in contact with the outer wall surface of the inner sleeve; and wherein an intermediate portion of the casing has a running-in generally collapsed configuration which is subsequently openable while in the well to a generally cylindrical configuration.

32. The casing according to claim 31 wherein the collapsed configuration is generally in the shape of a horseshoe and the inner and outer sleeves are of the same metal.

33. The casing according to claim 31 wherein at least one of the wall surfaces has a friction enhancing surface treatment thereon to increase external pressure capability.

34. An apparatus for opening a casing from a generally collapsed configuration to a generally cylindrical configuration, comprising:

a forming head having a tapered exterior containing a plurality of flutes extending in straight lines from an upper end portion of the forming head to a lower end of portion of the forming head;

pushing means for pushing the forming head through the casing; and a plurality of balls which roll downward on the flutes to engage an internal surface of the casing in rolling contact and bend the casing radially outward to the cylindrical configuration while the forming head is pushed through the casing.

35. The apparatus according to claim 34, further comprising:

an axial ball passage extending through the forming head;

a lower ball chamber joining a lower end of the axial ball passage;

an upper lateral passage leading from an upper end of the axial ball passage to upper ends of the flutes;

wherein a plurality of the balls are initially located in the lower ball chamber;

wherein the pushing means includes a piston located in the lower ball chamber; and wherein moving the piston toward the forming head forces the balls from the lower ball chamber through the axial ball passage, out the upper lateral passage and into the flutes, with subsequent movement of the forming head by the pushing means causes the balls in the flutes to engage the casing in rolling engagement, and causes the balls to continuously cycle during the movement of the forming head from the lower ball chamber through the axial ball passage, out the upper lateral passage, down the flutes and back into the lower ball chamber.

36. A method for encasing a wellbore, comprising:

(a) forming a metal tubular casing with an intermediate portion which is in a generally collapsed configuration and winding the intermediate portion of the casing onto a reel in the generally collapsed configuration;

(b) deploying the intermediate portion of the casing from the reel and lowering the casing into the well; then (c) opening the intermediate portion of the casing from the collapsed configuration into a cylindrical configuration.

37. The method according to claim 36, wherein (a) further comprises placing an opening tool in a lower portion of the casing; and step (c) comprises:

advancing the opening tool upward from the lower portion through the intermediate portion.

38. An apparatus for encasing a well, comprising:

a string of metal casing having an intermediate portion formed in a generally collapsed configuration and wound onto a reel;

an opening tool having a forming head and located in a lower portion of the casing;

the intermediate portion of the casing adapted to be deployed from the reel and lowered into the well along with the lower portion; and the opening tool being upwardly movable from the lower portion through the intermediate portion, causing the head of to radially open the intermediate portion of the casing from the collapsed configuration into a cylindrical configuration.

* * * * *